US006296439B1

(12) United States Patent
Yu et al.

(10) Patent No.: US 6,296,439 B1
(45) Date of Patent: Oct. 2, 2001

(54) REGENERATIVE TURBINE PUMP IMPELLER

(75) Inventors: Dequan Yu, Ann Arbor; Ronald Luce Verkleeren, Dearborn, both of MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/344,396

(22) Filed: Jun. 23, 1999

(51) Int. Cl.[7] ..... F04D 1/04
(52) U.S. Cl. ..... 415/55.1; 416/203
(58) Field of Search ..... 415/55.1, 55.2, 415/55.3, 55.4, 55.5, 55.6, 55.7; 416/175, 203

(56) References Cited

U.S. PATENT DOCUMENTS

| | | | | |
|---|---|---|---|---|
| 1,635,786 | | 7/1927 | Holmes . | |
| 1,814,019 | | 7/1931 | Yoss . | |
| 2,671,404 | | 3/1954 | Krueger . | |
| 3,259,072 | | 7/1966 | Carpenter . | |
| 3,545,890 | | 12/1970 | Hubbard et al. . | |
| 3,917,431 | | 11/1975 | Rose . | |
| 3,947,149 | | 3/1976 | MacManus . | |
| 4,204,800 | | 5/1980 | Bentele et al. . | |
| 4,306,833 | | 12/1981 | Sixsmith et al. . | |
| 4,403,910 | | 9/1983 | Watanabe et al. . | |
| 4,508,492 | | 4/1985 | Kusakawa et al. . | |
| 4,591,311 | | 5/1986 | Matsuda et al. . | |
| 4,715,777 | | 12/1987 | Tuckey . | |
| 4,915,582 | | 4/1990 | Nishikawa . | |
| 5,123,809 | * | 6/1992 | Ito | 415/55.1 |
| 5,163,810 | * | 11/1992 | Smith | 415/55.1 |
| 5,209,630 | | 5/1993 | Roth . | |
| 5,284,417 | | 2/1994 | Yu . | |
| 5,310,308 | | 5/1994 | Yu et al. . | |
| 5,328,325 | | 7/1994 | Strohl et al. . | |
| 5,336,045 | | 8/1994 | Koyama et al. . | |
| 5,372,475 | * | 12/1994 | Kato et al. | 415/55.1 |
| 5,375,971 | | 12/1994 | Yu . | |
| 5,401,147 | | 3/1995 | Yu . | |
| 5,407,318 | | 4/1995 | Ito et al. . | |
| 5,409,357 | | 4/1995 | Yu et al. . | |
| 5,413,457 | | 5/1995 | Tuckey . | |
| 5,468,119 | | 11/1995 | Huebel et al. . | |
| 5,486,087 | | 1/1996 | Treiber et al. . | |
| 5,498,124 | | 3/1996 | Ito et al. . | |
| 5,507,617 | * | 4/1996 | Sun | 415/55.1 |
| 5,513,950 | | 5/1996 | Yu . | |
| 5,516,259 | * | 5/1996 | Niederkofler et al. | 415/55.1 |
| 5,551,835 | | 9/1996 | Yu et al. . | |
| 5,762,469 | | 6/1998 | Yu . | |
| 5,807,068 | * | 9/1998 | Dobler et al. | 415/55.1 |

FOREIGN PATENT DOCUMENTS

| | | |
|---|---|---|
| 876285 | 3/1953 | (DE) . |
| 0 563 957 A1 | 10/1993 | (EP) . |
| 0 87 903 A2 | 8/1997 | (EP) . |
| 2 218 748 | 4/1989 | (GB) . |
| WO 92/10680 | 6/1992 | (WO) . |
| WO 97/40275 | 10/1997 | (WO) . |

* cited by examiner

*Primary Examiner*—Edward K. Look
*Assistant Examiner*—Ninh Nguyen
(74) *Attorney, Agent, or Firm*—Brinks Hofer Gilson & Lione

(57) ABSTRACT

A regenerative turbine impeller comprises an annular disk having an annular partition wall extending radially therefrom. A first plurality of circumferentially spaced turbine vanes provided on one side of the partition wall radially projecting from the annular disk and have a radial length greater than the partition wall. A second plurality of circumferentially spaced turbine vanes circumferentially spaced about the disk extend radially therefrom and are provided on a second side of the partition wall. The second plurality of vanes rotationally staggered with respect to the first plurality of turbine vanes.

16 Claims, 4 Drawing Sheets

REGENERATIVE TURBINE PUMP IMPELLER

FIELD OF THE INVENTION

The present invention relates to an improved impeller for a regenerative turbine pump, and more particularly to such an impeller for use in an automotive fuel pump.

DESCRIPTION OF THE PRIOR ART

Regenerative turbine pumps have been used for years in automotive fuel supply applications, an example of which is shown in U.S. Pat. No. 3,259,072 to General Motors. This pump includes a plurality of vanes 38 separated by a partition wall (not numbered) extending from the tip of the vanes 38 to an annular portion of the impeller 36 to define a number of circumferentially spaced vane grooves (not numbered) between each adjacent pair of circumferentially spaced vanes on one side of the partition wall.

A design according to the '072 patent is commonly referred to as a closed vane impeller, because the partition wall extends to the end of the vanes. Because each vane extends across the width of the impeller, each opposing pair of vane grooves of the '072 patent is positioned on opposite sides of the partition wall in circumferential alignment, thus creating a mirror image of the vane grooves on either side of the partition wall, and therefore the vanes are not staggered. Attempts to provide this type of pump having quiet operation include U.S. Pat. No. 4,508,492, wherein the number of vanes is increased and the gap between the impeller and housing is controlled. UK Patent Application GB 2 218 748 A describes a closed vane impeller having channels 24 disposed on either side of a partition wall in a rotationally offset manner.

A low pressure pump alternative to such regenerative pumps (as shown in the '072 patent) includes a peripheral pump, illustrated in U.S. Pat. No. 3,947,149. Such a peripheral pump lacks the partition wall of the '072 design. An improvement to this peripheral pump includes staggering the vanes, as shown in U.S. Pat. No. 5,209,630 to General Motors Corporation to reduce noise by effectively increasing the number of vanes in such a peripheral pump. However, a pump according to the '603 patent, being a peripheral pump, is used as a lift pump in a low pressure fuel system, as it would deadhead in a high pressure fuel system.

A further alternative to the '072 design includes another regenerative turbine design, as illustrated in U.S. Pat. No. 5,409,357, assigned to the assignee of the present invention, which is incorporated herein by reference. A pump according to the '357 patent includes an impeller having a partition wall 56 between the vanes 50, so as to not form a peripheral impeller as in the '149 and '630 patents; the partition wall does not extend to the end of the vanes so as to not form a closed vane impeller as in the '072 patent. A pump according to this configuration ('357) operates more efficiently and is capable of supplying fuel in a high pressure fuel system. However, as vehicles become more quiet, the noise generated by a pump according to the '357 patent may become objectionable. It would be desirable to provide an open vane impeller with improved levels of noise produced during operation of a pump having such an impeller.

SUMMARY OF THE INVENTION

The inventors propose an improved regenerative turbine impeller that is not a closed vane impeller and not a peripheral pump as described above, in one embodiment the impeller being similar to that described in the '357 patent, yet having reduced noise while in operation and pumping fluid.

Accordingly, a pump includes an impeller rotatable about an axis for pumping a fluid. The impeller includes an annular disk having an annular partition wall extending radially therefrom. A first set of circumferentially spaced turbine vanes are provided on one side of the partition wall radially projecting from the annular disk. A second set of circumferentially spaced turbine vanes are circumferentially spaced about the disk and extend radially therefrom. The second set is provided on a second side of the partition wall and are rotationally staggered with respect to the first plurality of turbine vanes. The vanes have a radial length greater than the partition wall.

A pump using an impeller according to the present invention is thus able to operate more quietly, while operating in a relatively high pressure fuel system at high efficiency.

DETAILED DESCRIPTION OF THE PREFERRED EMBODIMENTS

Figure 1:
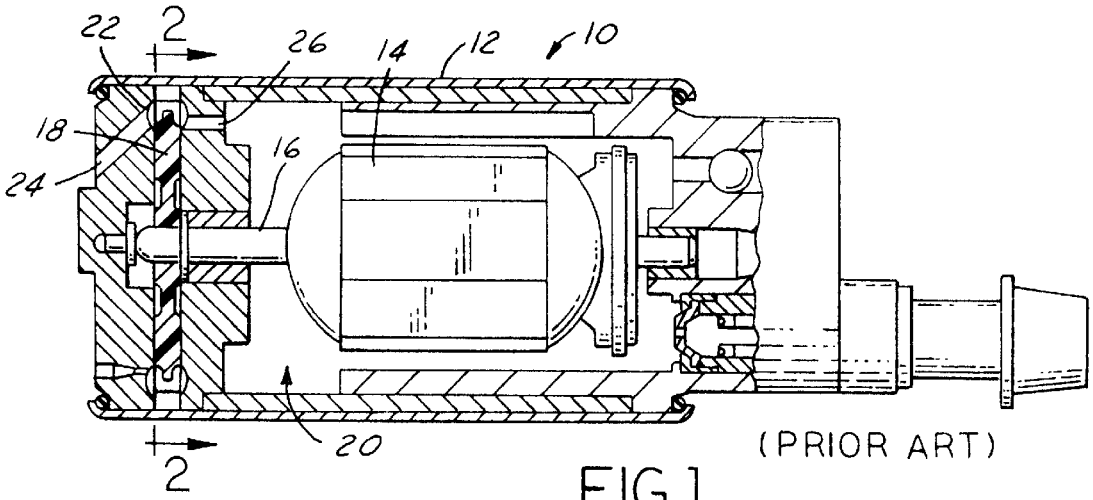
(PRIOR ART) FIG. 1
FIG. 1 is a cross-sectional view of a prior art fuel pump having a rotary impeller.

Referring now to FIG. 1, a fuel pump 10 has a housing 12 within which its components are housed. An electric motor 14 and shaft 16 are mounted within the pump housing 12 in the region of a motor area 20. A rotary pumping element, preferably an impeller 18, is loosely fitted onto a shaft 16. The shaft 16 rotates the impeller 18 within the pumping chamber 22. The pumping chamber 22 has a fuel inlet 24 connecting the pumping chamber 22 to a fuel supply, such as a fuel tank (not shown). The pumping chamber 22 also has an outlet 26 in fluid communication with the motor area 20. Fuel is drawn into the pumping chamber 20 to the fuel inlet 24 by the impeller 18 and is discharge through the chamber outlet 26 into the motor area 20 thereby cooling the motor 14 while passing to the fuel pump outlet 28.

Figure 2:
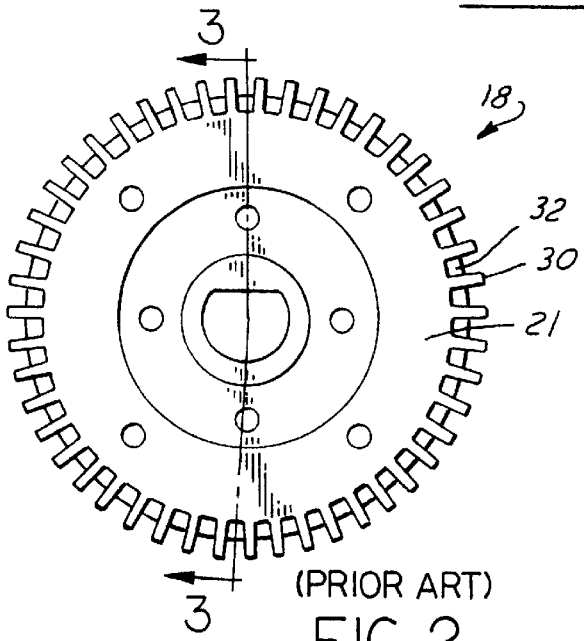
(PRIOR ART) FIG. 2
FIG. 2 is a side view of a prior art impeller for the fuel pump in FIG. 1.
Figure 3:
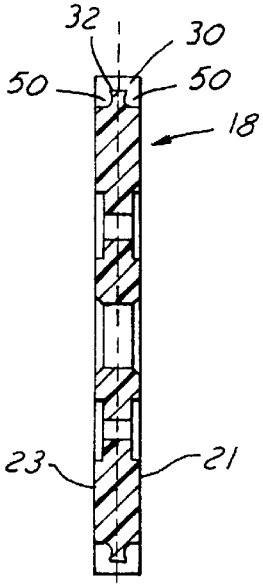
(PRIOR ART) FIG. 3
FIG. 3 is a sectional view along line 3—3 of FIG. 2 showing a vane and vane groove formed by a partition wall in the prior art impeller.

FIG. 2 shows a side view of the impeller 18 of FIG. 1. The impeller 18 includes a plurality of circumferentially-spaced vanes 30, one of which is indicated. As shown in FIG. 3, the vanes 30 extend continuously across the width of the impeller 18 from one side 21 to the opposite side 23. A partition wall 32 is provided annularly about the impeller 18 so as to define a plurality of vane grooves 50, one of which is provided between each adjacent pair of vanes 30 on either side of the partition wall 32, as best viewed in FIG. 3. As indicated above, the vanes 30 extend across the width of the impeller 18, and therefore the vane grooves 50 are rotationally aligned on either side of the impeller 18.

Figure 4:
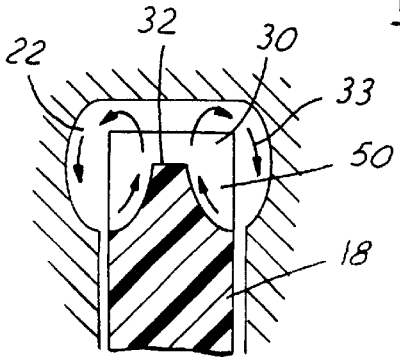
(PRIOR ART) FIG. 4
FIG. 4 is a close-up of a vane groove of FIG. 3 within the pumping chamber of the pump in FIG. 1.
Figure 5:
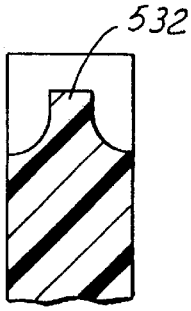
(PRIOR ART) FIG. 5
FIG. 5 is a cross sectional view of an alternate prior art impeller for FIG. 4.
Figure 6:
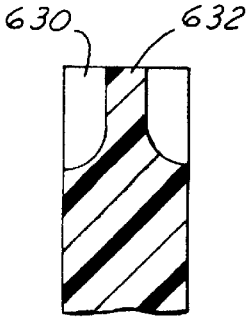
(PRIOR ART) FIG. 6
FIG. 6 is a cross sectional view of an alternate prior art impeller for FIG. 4.

As shown in FIG. 4, while the pump 10 is in operation, a pair of vortices, one indicated at 33, are formed, one on each side of the partition wall. As shown in FIGS. 4 and 5 various partition walls 32, 532 may be used in the present invention. In FIG. 6, a prior art closed vane impeller is shown, the partition wall 632 extending coextensive with the end of the vane 630.

Figure 7:
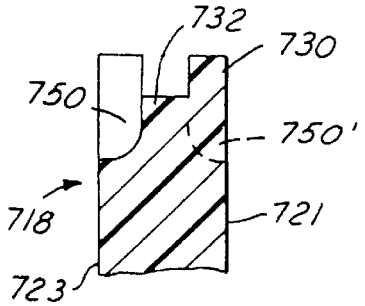
FIG. 7 is a cross sectional view of an alternate impeller according to the present invention useful in a pump similar to the pump shown in FIGS. 1 and 4.
Figure 8:
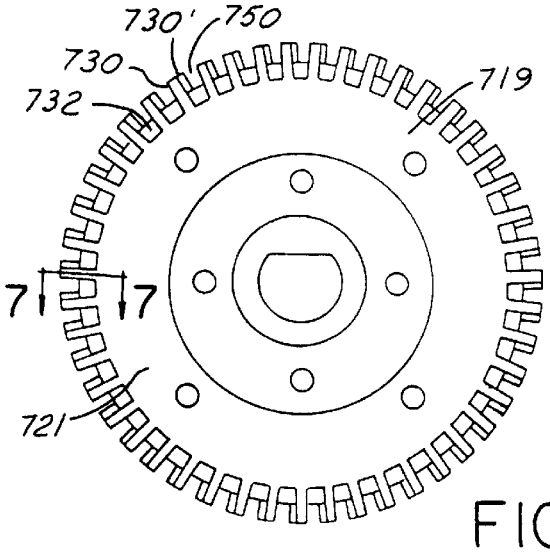
FIG. 8 is a side view of the impeller shown in FIG. 7.

According to the present invention, FIG. 7 illustrates an improved impeller 718 according to the present invention. In FIGS. 7 and 8, the impeller. 718 includes an annular disc portion 719. Extending radially from the disc portion 719 is a partition wall 732 provided approximately at the center of the disc 719 between sides 721 and 723. A plurality of radially extending vanes 730 are provided, half of the vanes 730 provided on a first side of the partition wall 732 and extending axially to a first side 723 of the impeller 718. A second plurality of vanes 730' are provided on the opposite side of the partition wall 732 and extend to the opposite face 721 of the impeller 718. The second plurality of vanes 730' are positioned on the impeller 718 in a rotated situation relative to the first plurality of vanes 730, or are "staggered" thereto.

Figure 9:
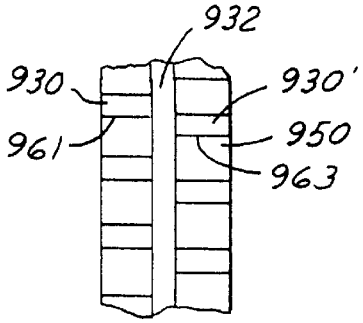
FIG. 9 is a partial plan view of the impeller shown in FIG. 7.
Figure 10:
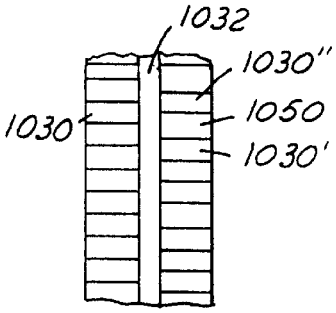
FIGS. 10–12 are partial plan views of alternate impellers according to FIG. 7.
Figure 11:
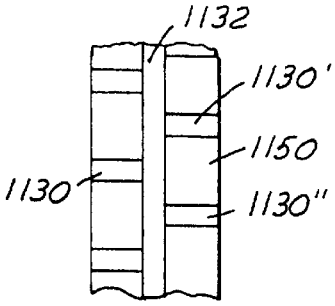

As shown in FIGS. 9–11, the amount of "staggering" of the vanes is schematically represented and one skilled in the art appreciates the staggering may be varied for a particular pump to get the desired sound quality. FIGS. 9–11 are illustrative and not exhaustive of the staggering useful with the present invention. So for instance, the vanes 930, 930' of FIG. 9 are staggered so that the front of one vane 930 is aligned rotationally with the back of a corresponding vane 930' on the opposite side of the partition wall 932.

In FIGS. 10 and 11, the staggering comprises some vane 1030, 1030' overlap in FIG. 10 and in FIG. 11, a first vane 1130 is provided approximately mid-way between two vanes 1130' on the opposite side of the partition wall 1132. Furthermore, one skilled in the art appreciates the vane shapes and spacing shown in FIGS. 8–13 are not necessarily accurate representations of efficient impeller designs, but are provided to schematically represent the specific features described herein.

Figure 12:
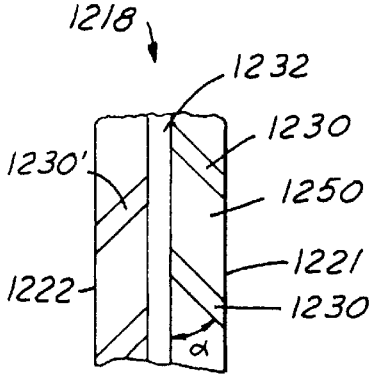

In a preferred embodiment shown in FIG. 12, the vanes 1230 have a chevron-shape. This chevron-shape comprises the vanes 1230 extending from one side wall 1221 of the impeller 1218 to the partition wall 1232 at an angle $\alpha$ other than 90 degrees, thereby forming a substantially chevron-shaped configuration with a corresponding second angled vane 1230' on the opposite side of the partition wall 1232. The second vane 1230' extends from the partition wall 1232 to a second face 1222 at preferably a corresponding angle. As appreciated by one skilled in the art, the impellers form an angle of less than 1800 in the direction of rotation of the impeller, as shown in FIG. 12. Further, a plurality of vane grooves 1250 are formed between adjacent vanes 1230, as described above.

Figure 13:
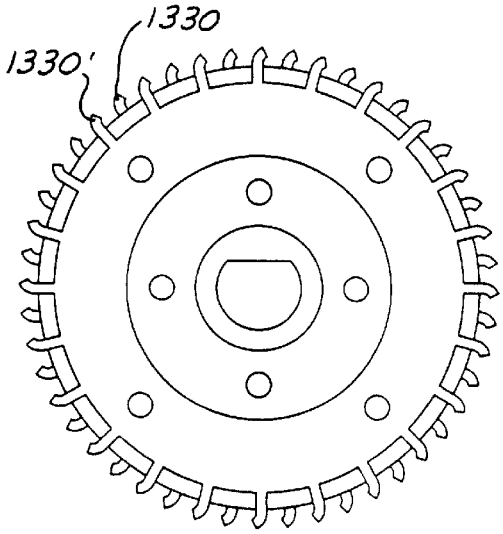
FIG. 13 is a side view of an alternate impeller according to the present invention useful in a pump similar to the pump shown in FIGS. 1 and 4.

As shown in FIG. 13, a preferred embodiment further includes the vanes 1330, 1330' having an arcuate shape, as described in my U.S. Pat. No. 5,513,950, which is incorporated herein by reference. Also, a preferred partition wall includes a parallel portion as described in my U.S. Pat. No. 5,409,357, which is incorporated herein by reference.

As best described with respect to FIG. 8, a first vane 730 is circumferentially spaced from second vane 730' formed on the opposite side of the partition wall 732. Each of preferably approximately 47 vanes 730 on each side of the impeller 732 is formed on an approximately 30 mm impeller 732 and is staggered with respect to a corresponding vane 730' on the opposite side of the wall 732. The inventors have found that varying degrees of staggering provides varying degrees of improvement in the noise generation characteristics of the impeller.

Thus, as illustrated in FIG. 9, a preferred embodiment includes the vanes 930, 930' being staggered to a degree such that no overlap exists at the partition wall when viewed from the side view, as shown in FIG. 8. The impeller of FIG. 9 essentially shows where the front face 961 of a first vane is terminated, the rear face 963 of a corresponding vane 930' begins.

In an alternative embodiment, as shown in FIG. 11, the first vane 1130 is positioned between two opposite vanes 1130' and 1130" to substantially bisect the vane groove 1150 therebetween.

In a further embodiment, as illustrated in FIG. 10, an overlap exists between a portion of the first vane 1030 and the corresponding vane 1030' on the opposite side of the partition wall 1032. As is shown in FIG. 8, the vanes 730 may extend radially in a straight manner having any of the configurations described heretofore in FIGS. 5–7. Similarly, the vanes may extend axially in a straight manner as shown in FIGS. 9–11.

It is believed that an impeller according to the present invention operates in a manner between a peripheral impeller and a closed vane impeller, as described in the Background. Thus, as one views the impeller in FIG. 8, a portion of each vane groove 750 is closed by the staggered vane 750'. Therefore, the fluid as it regenerates within the vane groove 750, may impinges upon the opposing vane 730', versus impinging upon a dead zone and/or merging into the impeller vane groove on the opposite side of the present vane groove. Thus, in a preferred embodiment, the partition wall 732 has a parallel portion as described in my '357 patent to avoid impingement on the opposing vane 730'. Preferably the partition wall 732 has a thickness at the outermost portion of approximately 0.2–1 mm. Additionally, a pump using an impeller according to the present invention is capable of operating in a fuel system of 1–5 bar or greater.

Figure 14:
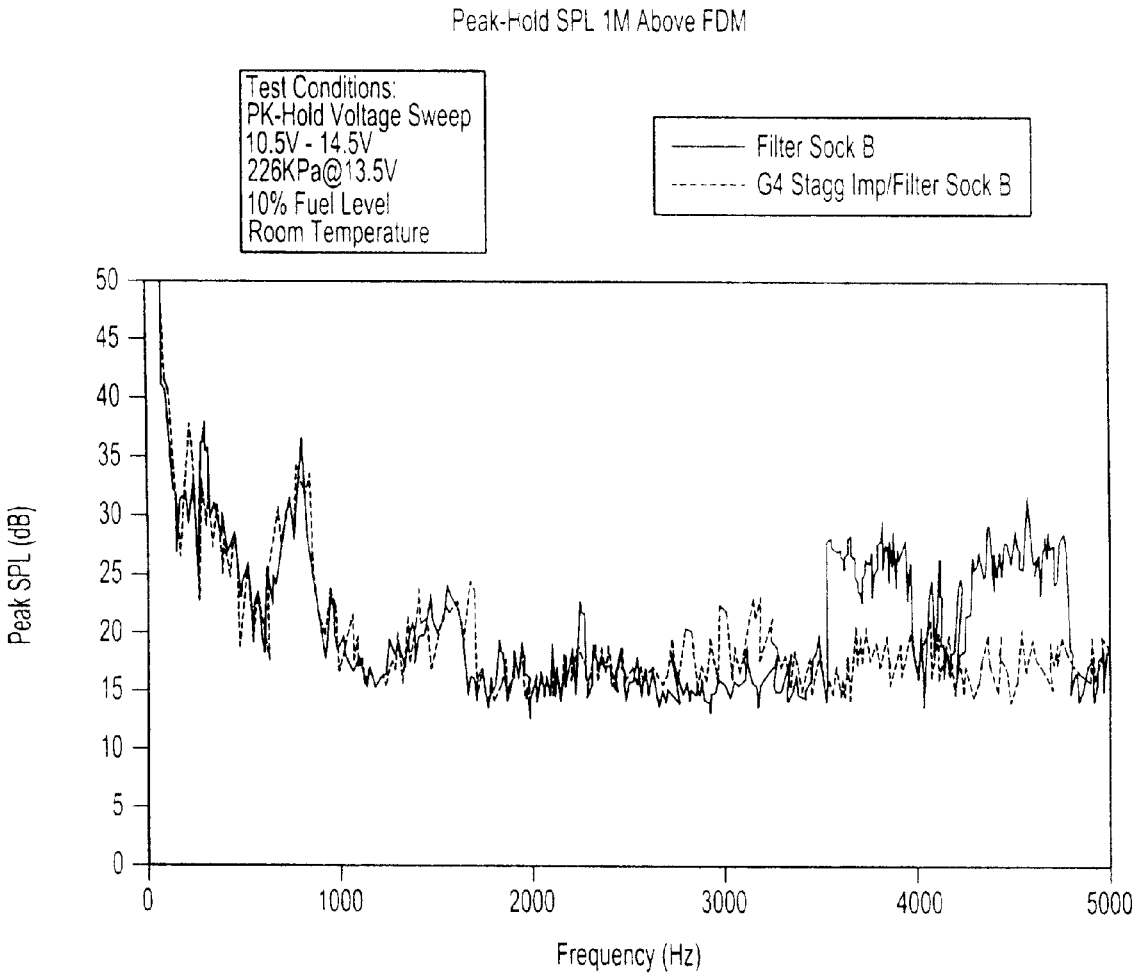
FIG. 14 is a chart illustrating the noise reduction for a staggered vane.

As shown in the chart of FIG. 14, the 25 staggered vanes provide appreciable improvement in noise at between about 3500–5000 Hz in the example above. In the example cited above, with 47 teeth running at about 6000 RPM is equivalent to 4700 Hz. One skilled in the art appreciates that the number of teeth, and the RPM of the motor mostly effect the frequency in which the improvement is effective.

Figure 15:
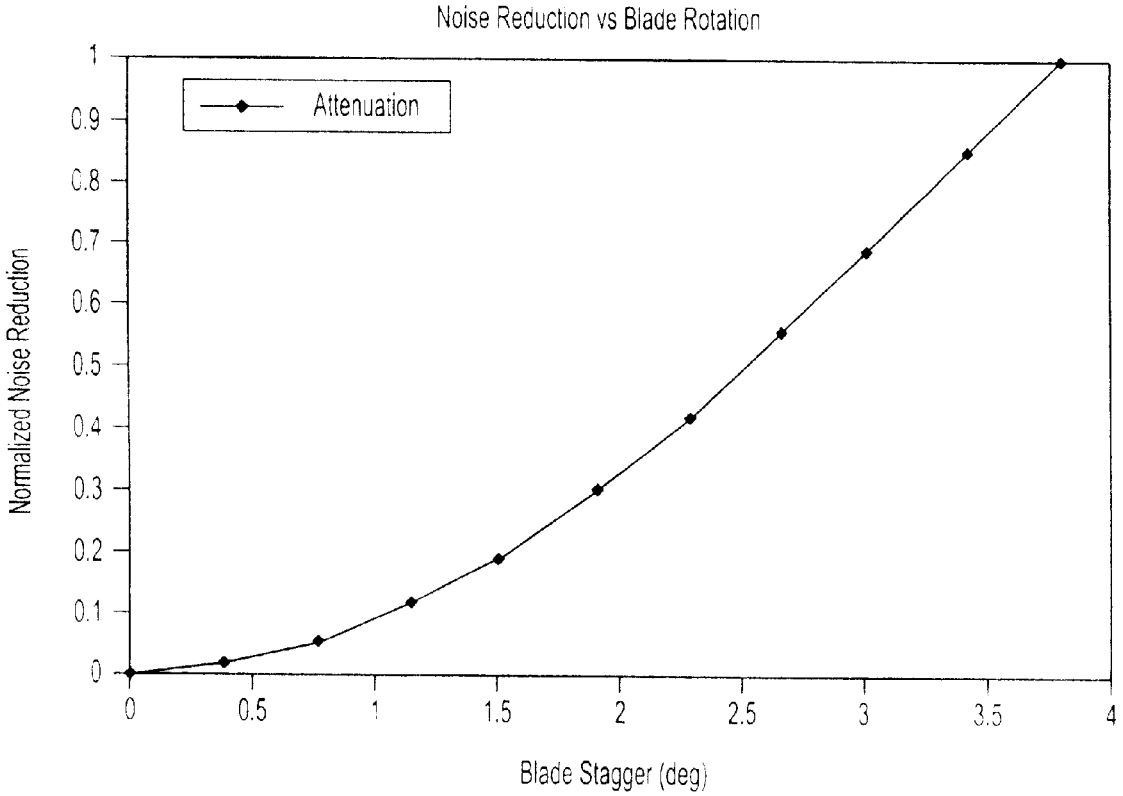
FIG. 15 is a chart illustrating the noise reduction as a function of impeller vane stagger.

As further shown in the chart of FIG. 15, the degree of noise attenuation in a particular pump is affected by the degree of vane stagger. We have found an impeller of 38 mm diameter having 47 vanes per side of the partition wall is best attenuated at about a 4 degree stagger. In this embodiment a 3.8 degree stagger produces a 180 phase difference.

However, one skilled in the art appreciates that the staggering will be unique for each configuration and the results desired.

Another embodiment of the present invention includes a ring portion, as shown in FIGS. 7–9 of the '357 patent at 76. The ring portion 76 is filled around an outer circumference of an impeller according to the present invention with the staggered vanes as described above, but having the ring 76 connected to said first and second plurality of vanes, as appreciated by one skilled in the art in a manner similar to the vanes 50 of the '357 patent shown in FIGS. 7–9 of the instant application at 730, 730'; 930, 930'.

Prior to this disclosure, one skilled in the art would have expected a regenerative turbine pump impeller having a partition wall extending for a length less than the length of the vanes to be an inefficient design . The common expectation is that, when used in a high pressure applications (more than 2 bars), back-flow may go through the space above the partition walls. This is best viewed with reference to my FIG. 12, which is a higher efficiency impeller design. Particularly with such a chevron-shape between the vanes as shown in FIG. 12, one skilled in the art would expect a back-flow, because the vanes apply a backward force upon the fluid within the plurality of vane grooves 1250. In a preferred embodiment of the present invention, a second vortex is formed in each cell by the interaction between flow and vanes and vane grooves in a manner described in my U.S. Pat. No. 5,762,469. Thus, the back-flow is prevented in a manner similar to the prime vortex used in many regenerative fuel pumps, wherein the prime vortex is used to prevent open channel back-flow from the pump outlet (high pressure) and the inlet (low pressure).

From the foregoing description, one of ordinary skill in the art can easily ascertain the essential characteristics of this invention, and without departing from the spirit and scope of the claims, can make various changes and modifications to the invention to adapt it to various usages an conditions.

What is claimed is:

1. A regenerative fuel pump for supplying fuel to an engine from a fuel tank, the pump comprising:

a pump housing;

a rotary pumping element in the form of an impeller within the pump housing, the impeller comprising a disc portion having an outer circumference, a first plurality of vanes circumferentially spaced about the outer circumference of the disc portion and a second plurality of vanes circumferentially spaced about the outer circumference of the disc portion, said second plurality of vanes rotationally staggered with respect to the first plurality of vanes;

a partition wall formed between the first plurality and the second plurality of vanes, said partition wall extending from the outer circumference for a distance less than the length of the first and second plurality of vanes;

the first plurality of vanes and said partition wall intersecting to define a first plurality of vane grooves, and said second plurality of vanes and said partition wall intersecting to form a second plurality of vane grooves;

the second plurality of vanes positioned rotationally immediately adjacent the first plurality of vanes so as to cover a portion of the first plurality of vane grooves immediately adjacent the first plurality of vanes when viewed from an axial end of the impeller.

2. A regenerative turbine pump according to claim 1, wherein the first plurality of vanes extend axially from the partition wall at an angle with respect to the axis and the second plurality of vanes extend axially from the partition wall at an angle with respect to the axis so as to form a staggered chevron-shape.

3. A regenerative turbine pump according to claim 1, wherein the first and second plurality of vanes have a curved shape when viewed from an end face of the impeller.

4. A regenerative turbine pump according to claim 1, wherein the impeller has an outside diameter measured from the end of the vanes within the range of about 15 to about 50 mm.

5. A regenerative turbine pump according to claim 1, wherein the partition wall includes a straight portion on each side thereof, said straight portions extending parallel to each other for about 0.1 to about 0.5 mm.

6. A regenerative turbine pump according to claim 1, wherein the partition wall has a thickness at a radially outermost portion thereof of approximately 0.2 to approximately 1.0 mm.

7. A regenerative turbine pump according to claim 1, wherein the second plurality of vanes is rotationally staggered approximately 4 degrees with respect to the first plurality of turbine vanes.

8. A regenerative fuel pump for supplying fuel to and engine from a fuel tank, the pump comprising:

a pump housing;

a rotary pumping element in the form of an impeller within the pump housing, the impeller comprising a disc portion having an outer circumference, a first plurality of vanes circumferentially spaced about the outer circumference of the disc portion and a second plurality of vanes circumferentially spaced about the outer circumference of the disc portion, said second plurality of vanes rotationally staggered with respect to the first plurality of vanes;

a partition wall formed between the first plurality and the second plurality of vanes, said partition wall extending from the disc portion outer circumference for a distance less than the length of the first and second plurality of vanes, the first plurality of vanes and the partition wall intersecting to define a first plurality of vane grooves and the second plurality of vanes and said partition wall intersecting to form a second plurality of vane grooves;

the first and second plurality of vanes having a curved shape when viewed from an end face of the impeller.

9. A regenerative turbine pump according to claim 8, wherein the second plurality of vanes are positioned between the first plurality of vane grooves when viewed from an axial end of the impeller.

10. An impeller according to claim 8, wherein the second plurality of vanes is rotationally staggered approximately 4 degrees with respect to the first plurality of turbine vanes.

11. A regenerative turbine pump according to claim 8, wherein the first plurality of vanes extend axially from the partition wall at an angle with respect to the axis and the second plurality of vanes extend axially from the partition wall at an angle with respect to the axis so as to form a staggered chevron-shape.

12. A regenerative fuel pump for supplying fuel to an engine from a fuel tank, the pump comprising:

a pump housing; and a regenerative turbine impeller having an annular disc having an annular continuous partition wall extending radially therefrom, a first plurality of turbine vanes circumferentially spaced about and radially projecting from said annular disc, and a second plurality of turbine vanes circumferentially spaced about and radially projecting from said annular disc, said first plurality of turbine vanes being provided on a first side of said continuous partition wall while said second plurality of turbine vanes being provided on a second side of said continuous partition wall, said first and second plurality of turbine vanes both having a radial length greater than said continuous partition wall, and said second plurality of turbine vanes being rotationally staggered relative to said first plurality of turbine vanes.

13. The regenerative turbine pump of claim 12, wherein said first and second turbine vanes extend axially from said continuous partition wall at an angle with respect to an access of said annular disc to form a staggered chevron-shape between corresponding first and second turbine vanes.

14. The regenerative turbine pump of claim 12, wherein each of said first plurality and second plurality of turbine vanes have an arcuate shape.

15. The regenerative turbine pump of claim 12, wherein said partition wall includes a straight portion on each side thereof, said straight portions extending parallel to each other.

16. The regenerative turbine pump of claim 12, wherein said second plurality of turbine vanes are rotationally staggered less than ½ of the circumferential distance between adjacent turbine vanes.

* * * * *

UNITED STATES PATENT AND TRADEMARK OFFICE

CERTIFICATE OF CORRECTION

PATENT NO. : 6,296,439 B1
DATED : October 2, 2001
INVENTOR(S) : Yu et al.

It is certified that error appears in the above-identified patent and that said Letters Patent is hereby corrected as shown below:

Column 6,
Line 24, delete “and” and insert -- an --.

Signed and Sealed this

Fourth Day of June, 2002

*Attest:*

*Attesting Officer*

JAMES E. ROGAN
*Director of the United States Patent and Trademark Office*